US011486151B2

(12) United States Patent
Zhou

(10) Patent No.: US 11,486,151 B2
(45) Date of Patent: Nov. 1, 2022

(54) FLOOR MOUNTING TOOLING AND FLOOR MOUNTING DEVICE

(71) Applicant: GUANGDONG BRIGHT DREAM ROBOTICS CO., LTD., Guangdong (CN)

(72) Inventor: Weian Zhou, Foshan (CN)

(73) Assignee: GUANGDONG BRIGHT DREAM ROBOTICS CO., LTD., Guangdong (CN)

( * ) Notice: Subject to any disclaimer, the term of this patent is extended or adjusted under 35 U.S.C. 154(b) by 0 days.

(21) Appl. No.: 17/427,451

(22) PCT Filed: Sep. 22, 2020

(86) PCT No.: PCT/CN2020/116797
§ 371 (c)(1),
(2) Date: Jul. 30, 2021

(87) PCT Pub. No.: WO2021/189787
PCT Pub. Date: Sep. 30, 2021

(65) Prior Publication Data

US 2022/0205257 A1 Jun. 30, 2022

(30) Foreign Application Priority Data

Mar. 27, 2020 (CN) ..... 202010231904.0

(51) Int. Cl.
*B66F 3/00* (2006.01)
*E04F 21/22* (2006.01)
*E04F 15/02* (2006.01)

(52) U.S. Cl.
CPC ..... *E04F 21/22* (2013.01); *E04F 15/02038* (2013.01); *E04F 2201/0153* (2013.01); *E04F 2201/023* (2013.01)

(58) Field of Classification Search
CPC .. E04G 21/16; B25B 7/02; B25B 7/14; B25B 27/02; E04F 13/0892; E04F 15/02022;
(Continued)

(56) References Cited

U.S. PATENT DOCUMENTS 5,139,231 A * 8/1992 Temple ..... B66F 15/00 254/113
6,616,132 B1 * 9/2003 Ellison ..... E04F 21/22 269/15

(Continued)

FOREIGN PATENT DOCUMENTS

CN 101057049 10/2007
CN 201991202 U 9/2011

(Continued)

OTHER PUBLICATIONS

International Search Report and Written Opinion issued for International Application No. PCT/CN2020/116797, dated Dec. 30, 2020, 9 pages.

(Continued)

*Primary Examiner* — Chi Q Nguyen
(74) *Attorney, Agent, or Firm* — Hamre, Schumann, Mueller & Larson, P.C.

(57) ABSTRACT

A floor mounting tooling and mounting device, the floor mounting tooling includes: a telescopic member; a hook, which is pivotally provided on the telescopic member, the hook has an initial position on the telescopic member, a hook portion is provided on a side of the hook proximate to the telescopic member, the hook portion is used to fit into the engaging slot to hook the floor, and the hook is configured to be rotatable within a defined angle range with respect to the engaging slot; an elastic member, which is provided
(Continued)

between the hook and the telescopic member, and the elastic member is configured to drive the hook to rotate toward the initial position.

11 Claims, 5 Drawing Sheets

(58) Field of Classification Search
CPC ..... E04F 21/1877; E04F 21/22; E04F 15/08; E04F 13/142; E04F 21/18; E04F 21/1855; E04F 13/0864; E04F 13/0885; E04F 15/02038; E04F 2201/0153; E04F 2201/023; E04D 15/00; E04D 15/04; E04D 15/025
USPC ... 52/748.1, 749.1, 749.13, 478, 127.1, 549, 52/547, 553, DIG. 1; 248/225.21, 244, 248/322, 307, 215, 304, 300, 340, 303, 248/301, 453; 296/296; 33/647, 613, 33/646; 254/11
See application file for complete search history.

(56) References Cited

U.S. PATENT DOCUMENTS

| | | | | |
|---|---|---|---|---|
| 6,962,179 | B1 * | 11/2005 | Brodersen | E04F 21/22 144/270 |
| 8,434,738 | B1 * | 5/2013 | Anstett | E04F 21/22 254/12 |
| 8,708,310 | B2 * | 4/2014 | Edgerly | E04F 21/22 52/749.11 |
| 9,435,129 | B1 * | 9/2016 | Horne | E04F 21/1855 |
| 10,640,991 | B1 * | 5/2020 | Corona | B66F 19/00 |
| 11,045,933 | B2 * | 6/2021 | Fransson | B27M 3/0066 |
| 2006/0278859 | A1 * | 12/2006 | Fraley | E04F 21/22 254/17 |
| 2008/0191180 | A1 | 8/2008 | Gaunt | |
| 2008/0236093 | A1 | 10/2008 | Coleman | |
| 2009/0194749 | A1 * | 8/2009 | Mirocha | E04F 21/22 254/13 |
| 2013/0298736 | A1 * | 11/2013 | Shishkin | B25B 13/12 81/179 |
| 2018/0178406 | A1 | 6/2018 | Fransson et al. | |
| 2019/0232356 | A1 * | 8/2019 | Lathrop | B21D 43/003 |
| 2021/0108425 | A1 * | 4/2021 | Li | B25B 7/02 |

FOREIGN PATENT DOCUMENTS

| | | |
|---|---|---|
| CN | 105201188 | 12/2015 |
| CN | 110087843 | 8/2019 |
| CN | 110565918 | 12/2019 |
| CN | 110565920 | 12/2019 |
| CN | 110656761 | 1/2020 |
| CN | 111287428 | 6/2020 |
| JP | S472726 U | 8/1972 |
| JP | S58156938 U | 10/1983 |
| JP | H0441034 U | 4/1992 |
| JP | 2008274657 | 11/2008 |
| JP | 2013023908 | 2/2013 |
| WO | 1999/001629 | 1/1999 |

OTHER PUBLICATIONS

First Office Action and search report issued for the Chinese Patent Application No. 202010231904.0, dated Jan. 5, 2021, 12 pages including English translation of the Office Action.
Extended European Search Report issued for European Patent Application No. 20914773.5, dated Jan. 24, 2022, 48 pages including English machine translations of documents CN 110656761 (previously cited) and JP 2013023908 (cited herein).
Office Action issued for Singaporean Patent Application No. 11202108997Q, dated Apr. 15, 2022, 9 pages.
Notice of Reasons for Refusal issued for Japanese Patent Application No. 2021-529728, dated Apr. 19, 2022, 4 pages including English translation.

* cited by examiner

FLOOR MOUNTING TOOLING AND FLOOR MOUNTING DEVICE

CROSS REFERENCE TO RELATED APPLICATION

The present disclosure claims priority of Chinese Patent Application No, 202010231904.0, entitled "floor mounting tooling and floor mounting device", filed on Mar. 27, 2020, the content of which is incorporated herein by reference in its entirety.

TECHNICAL FIELD

The present disclosure relates to the field of building construction, and particularly to a floor mounting tool and a floor mounting device.

BACKGROUND

Currently, floor is generally mounted on the ground by means of mutual engagement. An end of the floor is provided with an engaging protrusion and the other end is provided with an engaging slot. Two adjacent floors are mounted through fitting of the engaging protrusion and the engaging slot. In addition, in order to ensure the reliability of engagement connection, in some floors, the engaging protrusion is further provided with a protruding portion, and the engaging slot is provided with a groove that matches with the protruding portion. This kind of floor needs to be mounted at a certain angle of inclination during mounting. However, this kind of floor needs to be manually mounted, which has high labor intensity and low work efficiency.

Therefore, there is an urgent need for a floor mounting tooling that can replace manual floor mounting.

SUMMARY

The present disclosure aims to solve at least one of the technical problems existing in the prior art. For this reason, the present disclosure provides a floor mounting tooling to solve the problem of low efficiency of manual floor mounting.

The present invention further aims to provide a floor mounting device to apply the above-mentioned floor mounting tooling.

A floor mounting tooling according to an embodiment of the present disclosure is used to mount floor. two opposite sides of the floor are provided with an engaging protrusion and an engaging slot, respectively. The engaging protrusion of a floor is used to be fitted with the engaging slot of another floor. The floor mounting tooling includes: a telescopic member; a hook pivotally provided on the telescopic member, wherein the hook has an initial position on the telescopic member, a hook portion is provided on a side of the hook proximate to the telescopic member, the hook portion is used to fit in the engaging slot to hook the floor, and the hook is configured to be rotatable within a defined angle range with respect to the engaging slot; an elastic member provided between the hook and the telescopic member, wherein the elastic member is configured to drive the hook to rotate toward the initial position.

In the floor mounting tooling according to an embodiment of the present disclosure, through the telescopic member and the hook pivotally provided on the telescopic member, the floor can be tilted to a preset angle to be mounted on the mounted floor through mechanical operation, which is beneficial for reducing labor intensity and improving work efficiency. Through a telescopic action of the telescopic member, it can eliminate positioning errors and angle errors to improve the mounting accuracy during floor mounting.

In some embodiments, the telescopic member includes a driving member and a telescopic portion. The driving member is connected to the telescopic portion to drive the telescopic portion to extend or retract along a mounting direction of the floor. The hook is pivotally provided on the telescopic portion.

In some embodiments, the hook includes: a main body formed as a rectangular plate shape; two lugs provided at both ends of the main body in a length direction, wherein the hook and the lugs are provided at both ends of the main body in a width direction, and the two lugs are pivotally connected to the telescopic portion.

Alternatively, the floor mounting tooling further includes a rotating shaft provided on the telescopic portion. the two lugs are provided with mounting holes, both ends of the rotating shaft are respectively fitted in the two mounting holes.

Alternatively, the main body is provided with a receiving through hole, the receiving through hole is provided along a thickness direction of the main body, and the elastic member is inserted in the receiving through hole.

Alternatively, a side of the telescopic portion away from the main body is provided with a fixed plate, an end of the elastic member is connected to the fixed plate and the other end is provided in the receiving through hole.

Alternatively, two sets of the elastic members are provided along a length direction of the main body, two receiving through holes are provided along the length direction of the main body, and the two sets of the elastic members and the two receiving through holes are provided in a one-to-one correspondence.

Alternatively, each set of the elastic members has two elastic members spaced apart in the receiving through hole.

Alternatively, the elastic member is a spring, the main body is provided with two first through holes communicating with the receiving through holes, and the fixed plate is provided with two second through holes, in the two springs, an end of each spring is provided on the first through hole through a pin shaft, and the other end of each spring is hooked on the second through hole.

In some embodiments, the hook portion is formed on the bottom side of the main body away from the lugs.

A floor mounting device according to an embodiment of the present disclosure includes: an actuator, wherein the actuator can at least be used to vertically and horizontally move; a plurality of mounting toolings, wherein the plurality of mounting toolings are provided side by side on the actuator, and are any one of the above-mentioned floor mounting toolings.

The floor mounting device according to an embodiment of the present disclosure, by driving a vertical and horizontal movement of the mounting tooling, the mounting tooling can be mechanically operated to mount the floor at a certain angle of inclination, thereby replacing manual operation, greatly reducing labor intensity, and it is beneficial for improving the mounting efficiency of the floor.

The additional aspects and advantages of the present disclosure will be partly given in the following description, and partly will become obvious from the following description, or be understood through the practice of the present disclosure.

BRIEF DESCRIPTION OF THE DRAWINGS

The above-mentioned and/or additional aspects and advantages of the present disclosure will become obvious and easy to understand from the description of the embodiments in conjunction with the following drawings, in which.

Figure 1:
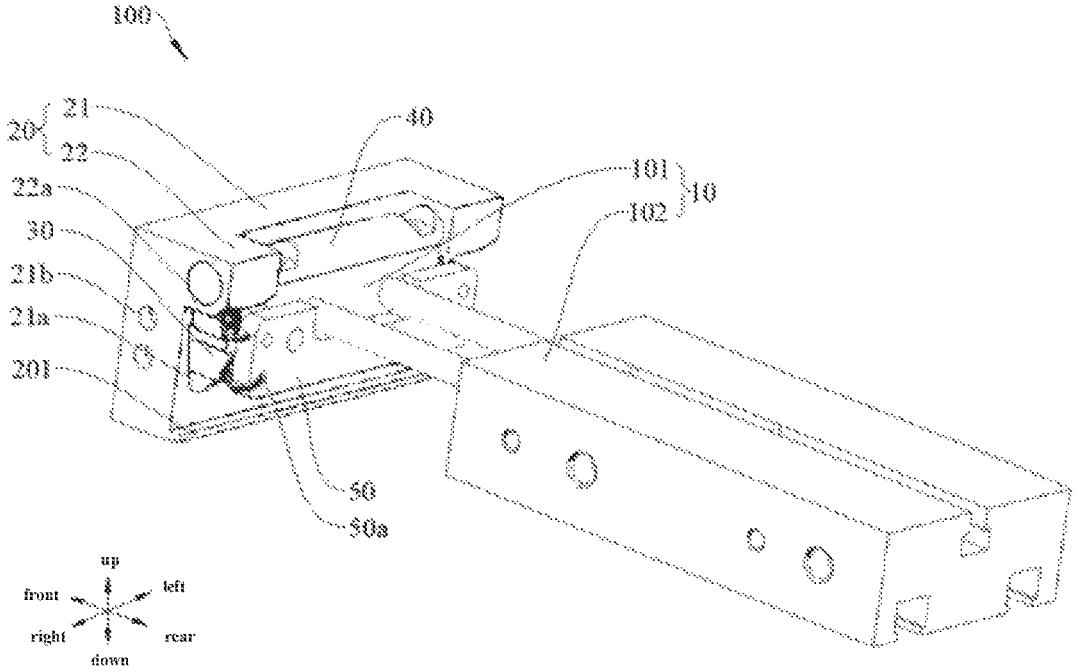
FIG. 1 is a schematic structure view of a floor mounting tooling in an embodiment of the present disclosure.

REFERENCE NUMBER mounting tooling 100, telescopic member 10, telescopic portion 101, driving member 102.

hook 20, hook portion 201, main body 21, receiving through hole 21*a*, two first through holes 21*b*, lug 22, mounting hole 22*a*, elastic member 30, rotating shaft 40, fixed plate 50, second through hole 50*a*, mounting device 1000, actuator 300, actuating end 310, floor 200, engaging protrusion 210, protruding; portion 211, engaging slot 220, groove 221.

DETAILED DESCRIPTION OF EMBODIMENTS

The embodiments of the present disclosure are described in detail below. Examples of the embodiments are shown in the accompanying drawings, in which the same or similar reference signs indicate throughout the same or similar elements or elements with the same or similar functions. The embodiments described below with reference to the accompanying drawings are exemplary, and are only used to explain the present disclosure, but should not be understood as limiting the present disclosure.

In the description of the present disclosure, it should be understood that orientation or positional relationships indicated by the terms "length", "width", "thickness", "upper", "lower", "front", "rear", "left". "right", "vertical", "horizontal", "top", "bottom", "inner", "outer" and the like are the orientation or positional relationships shown based on the accompanying drawings, and are only intended to facilitate the description of the present disclosure and simplify the description, rather than to indicate or imply that the mentioned device or element must have a specific orientation, be constructed and operated in a specific orientation, and therefore cannot be understood as a limitation of the present disclosure.

In addition, features defined with "first" and "second" may explicitly or implicitly include one or more of these features, which are used to distinguish and describe the features, and there is no order or severity.

In the description of the present disclosure, unless otherwise specified, "plurality" means two or more.

In the description of the present disclosure, it should be noted that, unless otherwise clearly specified and defined, the terms "mounting", "connected to each other" and "connected to" should be understood in a broad sense, for example, it can be a fixed connection or a detachable connection, or an integral connection; it can be a mechanical connection or an electrical connection; it can be directly connected or indirectly connected through an intermediate medium, and it can be an internal connection between two elements. For those of ordinary skills in the art, the specific meanings of the above-mentioned terms in the present disclosure can be understood in specific situations.

A floor mounting tooling 100 according to an embodiment of the present disclosure will be described below with reference to the accompanying drawings.

As shown in FIG. 1, a. floor mounting tooling 100 according to an embodiment of the present disclosure includes: a telescopic member 10, a hook 20, and an elastic member 30.

The floor mounting tooling 100 is used to mount a floor 200. Opposite sides of the floor 200 are provided with an engaging protrusion 210 and an engaging slot 220. The engaging protrusion 210 of one floor 200 is used to fit with the engaging slot 220 of another floor 200.

The hook 20 is pivotally provided on the telescopic member 10. The hook 20 has an initial position on the telescopic member 10. A side of the hook 20 proximate to the telescopic member 10 is provided with a hook portion 201, the hook portion 201 is used to fit in the engaging slot 220 to hook the floor 200, and the hook portion 201 is configured to be rotatable within a defined angle range with respect to the engaging slot 220. The elastic member 30 is provided between the hook 20 and the telescopic member 10, and the elastic member 30 is configured to drive the hook 20 to rotate toward the initial position.

Figure 2:
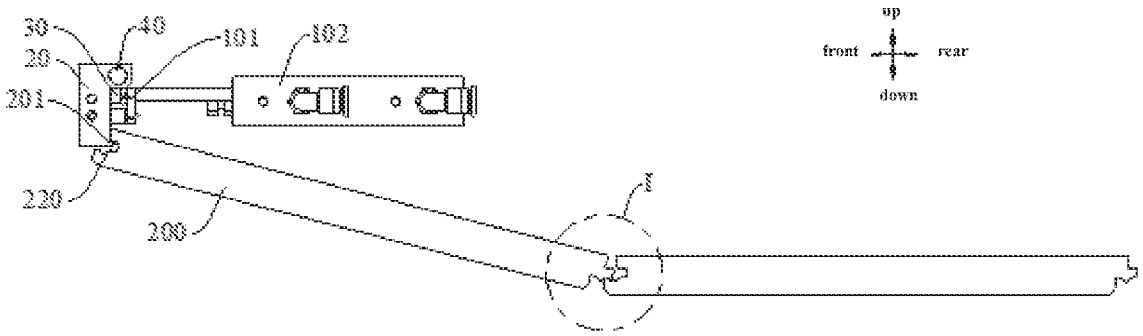
FIG. 2 is a first schematic view illustrating the floor mounting tooling used in conjunction with the floor in an embodiment of the present disclosure.
Figure 3:
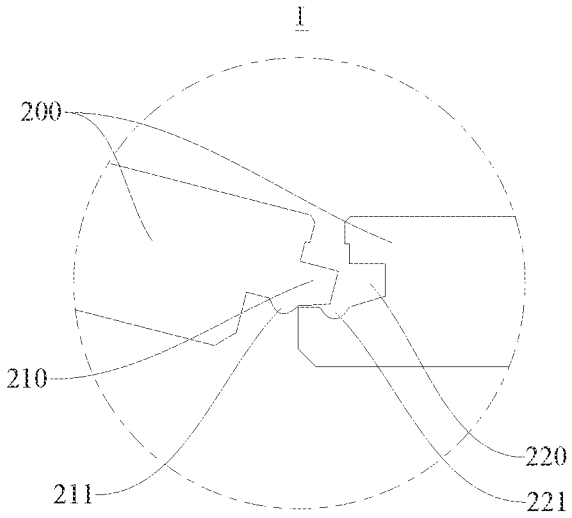
FIG. 3 is a partial enlarged schematic view illustrating I portion in FIG. 2.

It should be noted that, as shown in FIGS. 2 and 3, the engaging protrusion 210 of the floor 200 is provided with a protruding portion 211 and the engaging slot 220 of the floor 200 is provided with a groove 221. Therefore, a floor 200 to be mounted cannot be assembled on an mounted floor 200 along a horizontal direction, two adjacent floors 200 need to be mounted at a certain angle of inclination, and the mounting can only be done manually.

As shown in FIG. 2, when the present disclosure is used to mount the floor 200, the telescopic member 10 is moved to the floor 200 to be mounted, the telescopic member 10 is retracted to drive the hook 20 to move, the hook portion 201 is fitted in the engaging slot 220 of the floor 200 to be mounted. At this time, there is still a gap between the engaging protrusion 210 and the engaging slot 220, and the two floors 200 are not fully assembled. However, due to the pushing force, the telescopic member 10 makes a side of the floor 200 to be mounted flush with a side of the mounted floor 200, thereby eliminating positioning errors and angle errors and improving mounting accuracy. When the telescopic member 10 is lifted upwards, there is a gap between the hook portion 201 of the hook 20 and the engaging slot 220 of the floor 200 to be mounted. The floor 200 to be mounted is rotated around the previously mounted floor 200. When the telescopic member 10 continues to be lifted to a certain height and the gap is not enough for the floor 200 to be rotated, the elastic member 30 is retracted and the hook 20 is rotatable within a defined angle range on the telescopic member 10, that is, the hook 20 is rotated at a certain angle. When the angle is sufficient, the sides of the floors 200 are aligned and the mounting is completed. The telescopic member 10 is pressed downward, while being pressed downward, the telescopic member 10 exerts a lateral force on the floor 200 to be mounted through the hook 20 to ensure the floors 200 have no gap.

In addition, since the hook 20 is rotatable within a defined angle range on the engaging slot 220, the hook 20 is rotatable on the telescopic member 10, thereby providing an additional rotation angle, such that the floor 200 to be mounted can be rotated to a preset angle, an then the side of the floor 200 to be mounted is engaged into the mounted floor 200, which can solve the problem that the floor 200 cannot be pulled to the preset rotation angle.

It is worth noting that the floor mounting tooling 100 of the present disclosure can replace the manual mounting of the floor 200 to realize mechanized mounting operation. Meanwhile, it can realize automatic operation in combination with a robot. Since the robot has a certain positioning error and angle error, the positioning error is usually in the range of plus 5 mm to minus 5 mm, and the angle error is usually in the range of plus 1 degree to minus 1 degree. The present disclosure can eliminate the positioning error and the angle error, and improve the mounting accuracy when combined with the robot.

The floor mounting tooling 100 according to an embodiment of the present disclosure, through the telescopic member 10 and the hook 20 pivotally provided on the telescopic member 10, allows the floor 200 to be tilted to the preset angle and to be mounted into the mounted floor 200 through mechanical operation, which is conducive to reducing labor intensity and improving work efficiency. The telescopic member 10 can eliminate the positioning error and the angle error to improve the mounting accuracy during the mounting of the floor 200 through telescopic action.

In some embodiments, the telescopic member 10 includes a driving member 102 and a telescopic portion 101. The driving member 102 is connected to the telescopic portion 101 to drive the telescopic portion 101 to extend or retract along a mounting direction of the floor 200. The hook 20 is pivotally provided on the telescopic portion 101. For example, the driving member 102 is an air cylinder capable of performing a telescopic action. Certainly, the driving member 102 is not limited to this, and may also be any one of an oil cylinder, a hydraulic cylinder, and an electric push rod, which will not be repeated here.

In some embodiments, as shown in FIG. 1, the hook 20 includes: a main body 21 and two lugs 22, and the main body 21 is formed as a rectangular plate shape. The two lugs 22 are provided on both ends of the main body 21 in a length direction, and both lugs 22 are pivotally connected to the telescopic portion 101. For example, the length direction of the main body 21 is the same as a length direction of the floor 200, the two lugs 22 are provided on left and right sides of the telescopic portion 101, such that the connection between the hook 20 and the telescopic portion 101 is stable and reliable. The hook portion 201 and the lugs 22 are provided on both ends of the main body 21 in a width direction. For example, the lugs 22 are provided on an upper end of the main body 21, which is beneficial for the hook 20 to rotate with respect to the telescopic portion 101. The hook 201 is provided on a lower end of the main body 21, which is beneficial for the hook portion 201 to fit into the engaging slot 220 of the floor 200. In addition, since the main body 21 is formed as the rectangular plate shape, the hook portion 201 is provided on a long side of the rectangular plate shape, a contact area between the hook portion 201 and the engaging slot 220 is relatively large, so that the process of driving the floor 200 to rotate is stable and reliable.

Alternatively, as shown in FIG. 1, the floor mounting tooling 100 further includes a rotating shaft 40, the rotating shaft 40 is provided on the telescopic portion 101, both lugs 22 are provided with mounting holes 22*a*, and both ends of the rotating shaft 40 are respectively fitted into the two mounting holes 22*a*. In other words, the hook 20 is connected to the telescopic portion 101 through the rotating shaft 40, therefore, the rotation of the hook 20 with respect to the telescopic portion 101 is more reliable.

Alternatively, as shown in FIG. 1, the main body 21 is provided with a. receiving through hole 21*a*, and the receiving through hole 21*a* is provided along a thickness direction of the main body 21, and the elastic member 30 is inserted in the receiving through hole 21*a*. The receiving through hole 21*a* penetrates the main body 21 and provides a mounting space for the elastic member 30. Therefore, a distance from a connecting end between the main body 21 and the elastic member 30 to the telescopic portion 101 can be reduced, a volume of a structure formed by the telescopic portion 101 and the hook 20 is reduced, thereby simplifying the mechanism.

Alternatively, as shown in FIG. 1, a fixed plate 50 is provided on a side of the telescopic portion 101 away from the main body 21, one end of the elastic member 30 is connected to the fixed plate 50 and the other end of the elastic member 30 is provided in the receiving through hole 21*a*. A separate fixed plate 50 is provided on the telescopic portion 101 to facilitate a connection to the elastic member 30. Further, the fixed plate 50 and the receiving through hole 21*a* are provided on two opposite sides of the telescopic portion 101, such that a distance between the fixed plate 50 and the inside of the receiving through hole 21*a* is relatively long, which is beneficial to provide the elastic member 30.

Alternatively, two sets of the elastic members 30 are provided along the length direction of the main body 21, two receiving through holes 21*a* are provided along the length direction of the main body 21, and the two sets of the elastic members 30 and the two receiving through holes 21*a* are provided in a one-to-one correspondence. In other words, the elastic members 30 are provided on both sides of the main body 21, such as left and right sides of the main body 21. The two sides of the main body 21 are subjected to balanced elastic forces to ensure that under an action of the elastic members 30, the hook 20 rotates on the telescopic portion 101 stably and reliably.

Alternatively, each set of the elastic members 30 has two elastic members spaced apart in the receiving through hole 21*a*. By increasing the number of elastic members in each set of the elastic members 30, the ability of the hook 20 to rotate and reset toward the initial position is enhanced. Meanwhile, the lateral force on the floor 200 formed when the hook 20 rotates can be increased. Certainly, the number of the elastic members in each set of the elastic members 30 is not limited to this. For example, the number of the elastic members 30 in the receiving through hole 21*a* may be three or more, which will not be repeated here.

Alternatively, the elastic members 30 are springs, the main body 21 is provided with two first through holes 21*b* communicating with the receiving through holes 21*a*, and the fixed plate 50 is provided with two second through holes 50*a*. An end of each of the two springs is provided on the first through hole 21*b* through a pin shaft, and the other end of each of the two springs is hooked on the second through hole 50*a*. Both ends of the springs are mounted on the first through hole 21*b* and the second through hole 50*a* in a hooking manner, which allows the elastic member 30 to be mounted and disassembled more conveniently, thereby facilitating maintenance and replacement.

In some embodiments, as shown in FIG. 1, the hook portion 201 is formed on a bottom side of the main body 21 away from the lugs 22. In other words, the hook portion 201 is distributed along the bottom side of the main body 21, such that when the hook 20 is retracted with the telescopic portion 101, the hook portion 201 first contacts the floor 200 and is easily engaged into the engaging slot 220. In addition, the hook portion 201 is located on the bottom side of the main body 21, and the hook portion 201 is formed as a long strip shape, so that the contact surface with the engaging slot 220 is increased, and hook portion 201 can drive the floor 200 to rotate upwards smoothly.

In the following, a specific embodiment of the floor mounting tooling 100 of the present disclosure will be described with reference to the accompanying drawings.

As shown in FIG. 1, a floor mounting tooling 100 includes: a telescopic member 10, a hook 20, and an elastic member 30.

The telescopic member 10 is a liftable air cylinder, and the telescopic member 10 has a telescopic portion 101.

The hook 20 is pivotally provided on the telescopic portion 101. The hook 20 has an initial position on the telescopic portion 101. A hook portion 201 is provided on a side of the hook 20 proximate to the telescopic portion 101. The hook portion 201 is used to be fitted into an engaging slot 220 to hook a floor 200. The hook portion 201 is configured to be rotatable within a defined angle range with respect to the engaging slot 220.

The hook 20 includes a main body 21 and two lugs 22. The main body 21 is formed as a rectangular plate shape. The two lugs 22 are provided on left and right ends of the main body 21. The hook portion 201 and the lugs 22 are provided on upper and lower ends of the main body 21, and the hook portion 201 is formed on a bottom side of the main body 21 away from the lugs 22. Both lugs 22 are provided with mounting holes 22*a*, the telescopic portion 101 is provided with a rotating shaft 40, and both ends of the rotating shaft 40 are respectively fitted into the two mounting holes 22*a*. The main body 21 is provided with receiving through holes 21*a*, the receiving through holes 21*a* is provided to penetrate the main body portion 21 in a front-rear direction of the main body 21. Two receiving through holes 21*a* are provided, and the two receiving through holes 21*a* are provided on left and right sides of the main body 21.

The elastic member 30 is provided between the hook 20 and the telescopic portion 101, and the elastic member 30 is configured to drive the hook 20 to rotate toward the initial position. The elastic member 30 is a spring, and two sets of springs are provided. The two sets of springs are respectively provided in the two receiving through holes 21*a*. A rear side of the telescopic portion 101 is provided with a fixed plate 50, and a second through hole 50*a* is provided in the fixed plate 50. The main body 21 is provided with a first through hole 21*b* communicating with the receiving through holes 21*a*. An end of each spring is connected to the first through hole 21*b* by a pin shaft and the other end of each spring is hooked on the second through hole 50*a*. Each set of springs include two springs, two corresponding first through holes 21*b* are provided on the receiving through hole 21*a*, and two corresponding second through holes 50*a* are provided on the fixed plate 50.

Figure 5:
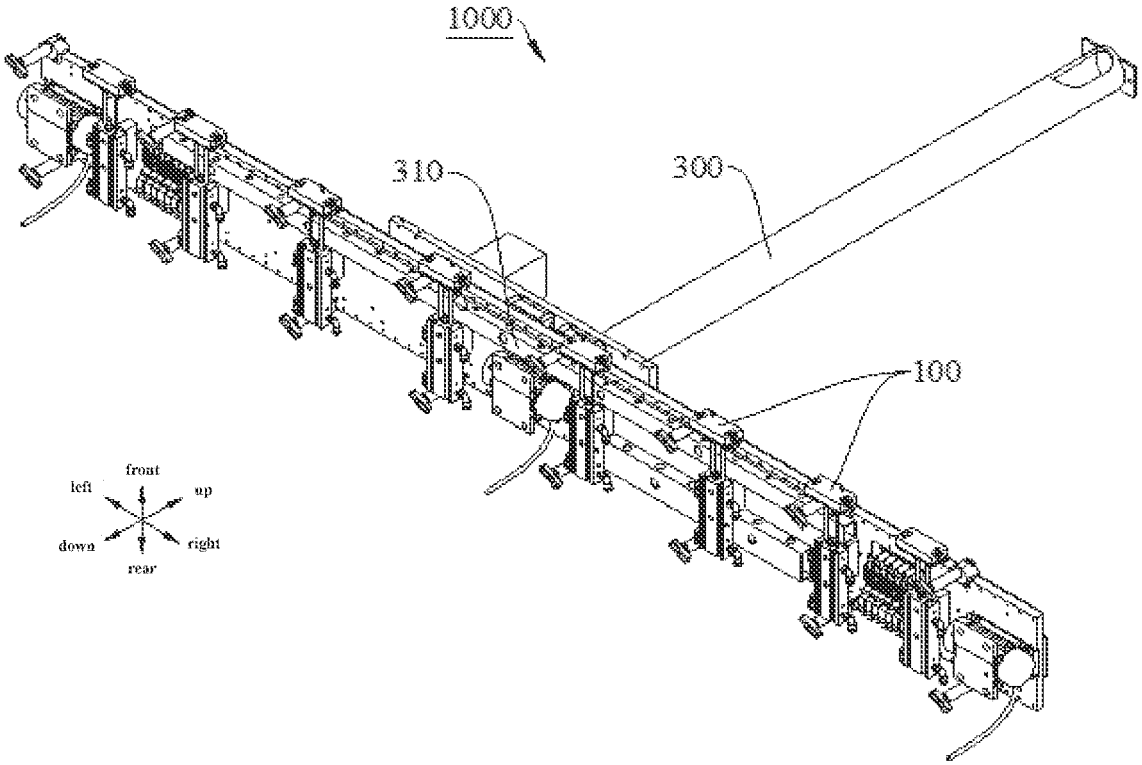
FIG. 5 is a three-dimensional schematic structure view of a floor mounting device in an embodiment of the present disclosure.

As shown in FIG. 5, a floor mounting device 1000 according to an embodiment of the present disclosure includes: an actuator 300 capable of at least be used to vertically and horizontally move; and a plurality of mounting toolings 100 provided side by side on the actuator 300. The mounting toolings 100 are any above-mentioned floor mounting toolings 100.

The floor mounting device 1000 according to an embodiment of the present disclosure, by driving the mounting tooling 100 to move vertically and horizontally, allows the mounting tooling 100 to be mechanically operated to mount floor 200 at a certain angle of inclination, thereby replacing manual operation and greatly reducing labor intensity. It is beneficial for improving the mounting efficiency of the floor 200.

Alternatively, the actuator 300 is a mechanical arm, and the mechanical arm is a six-axis degree of freedom mechanical arm.

Figure 6:
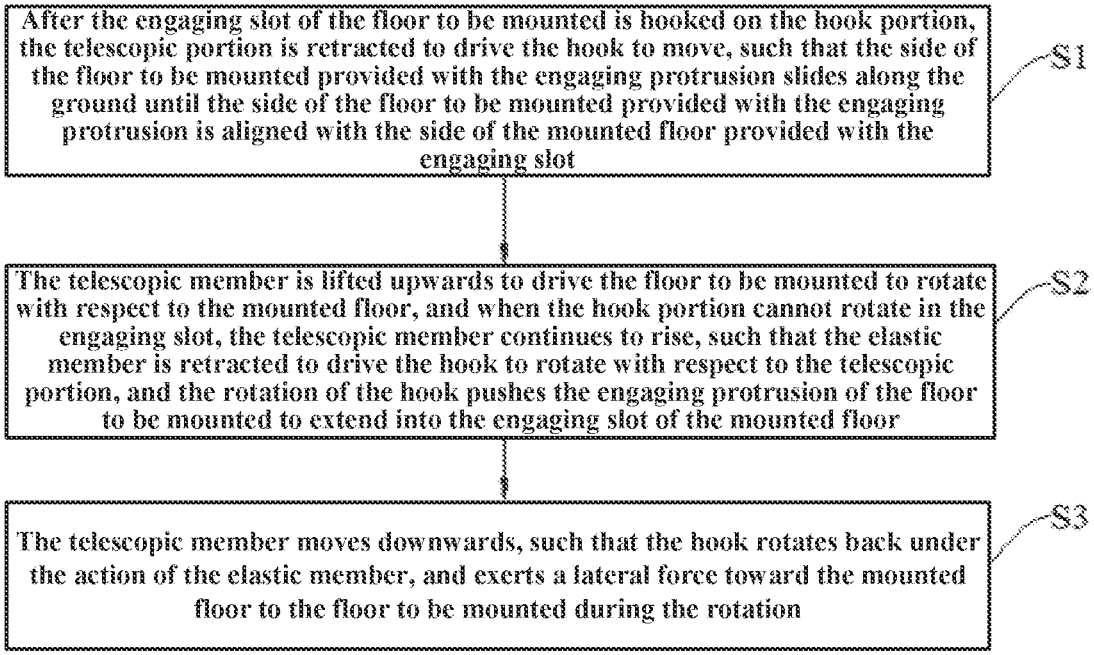
FIG. 6 is a schematic flowchart of a floor mounting method in an embodiment of the present disclosure.

As shown in FIG. 6, a floor mounting method according to an embodiment of the present disclosure is described.

As shown in FIG. 6, a floor mounting method, which uses a floor mounting tooling 100 to mount floor 200 to be mounted, and the floor mounting tooling 100 is any one of the above-mentioned floor mounting tooling 100.

As shown in FIG. 5, the floor mounting tooling 100 is mounted on an actuating end 310 of the actuator 300, and a plurality of floor mounting toolings 100 are provided side by side on the actuating end 310.

As shown in FIG. 6, the mounting of the floor 200 includes the following steps.

In step S1, after the engaging slot 220 of the floor 200 to be mounted is hooked on the hook portion 201, the telescopic portion 101 is retracted to drive the hook 20 to move, such that the side of the floor 200 to be mounted provided with the engaging protrusion 210 slides along the ground until the side of the floor 200 to be mounted provided with the engaging protrusion 210 is aligned with the side of the mounted floor 200 provided with the engaging slot 220. The specific process is as follows.

Figure 4:
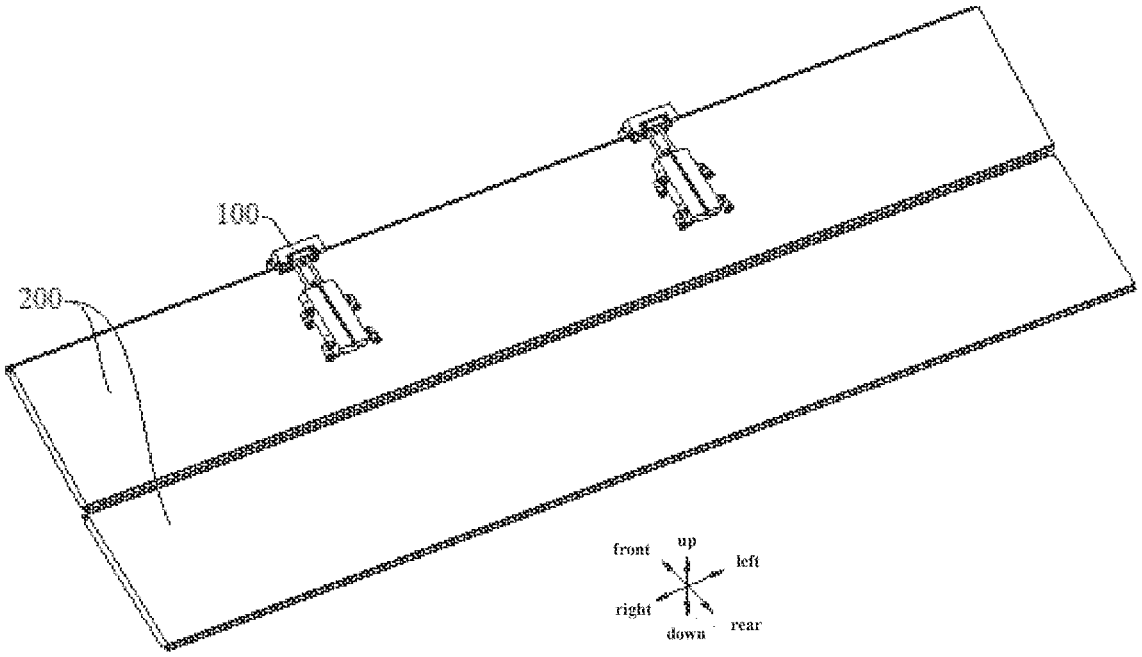
FIG. 4 is a second schematic view illustrating the floor mounting tooling used in conjunction with the floor in an embodiment of the present disclosure.

First, as shown in FIG. 4, the telescopic portion 101 of the telescopic member 10 is in an extended state. The telescopic portion 101 is located in front of the floor 200 to be mounted. The telescopic portion 101 is retracted to drive the hook 20 to move backwards, and the hook portion 201 is engaged into the engaging slot 220. As the telescopic portion 101 is continuously contracted, the floor 200 to be mounted moves backwards, and finally the side of the floor 200 to be mounted is aligned with the side of the mounted floor 200, and the engaging protrusion 210 of the floor 200 to be mounted extends into the engaging slot 220 of the mounted floor 200. Meanwhile, the hook 20 rotates forward on the telescopic portion 101 through the rotating shaft 40 to deviate from the initial position, and the elastic member 30 is stretched.

In step S2, the telescopic member 10 is lifted upwards to drive the floor 200 to be mounted to rotate with respect to the mounted floor 200. When the hook portion 101 cannot rotate in the engaging slot 220, the telescopic member 10 continues to rise. The elastic member 30 is retracted to drive the hook 20 to rotate with respect to the telescopic portion 101. The rotation of the hook 20 pushes the engaging protrusion 210 of the floor 200 to be mounted to extend into the engaging slot 220 of the mounted floor 200. Meanwhile, the protruding portion 211 of the engaging protrusion 210 is fitted with the groove 221 of the engaging slot 220.

In step S3, the telescopic member 10 moves downwards, such that the hook 20 rotates back under the action of the elastic member 30. and exerts a lateral force toward the mounted floor 200 to the floor 200 to be mounted during the rotation. Therefore, the gap between the engaging protrusion 210 of the floor 200 to be mounted and the engaging slot 220 of the mounted floor 200 is eliminated, and a seamless mounting of the floor 200 is ensured.

In the floor mounting method according to an embodiment of the present disclosure, the manual work can be replaced by the floor mounting tooling 100, so that the mechanized mounting of the floor 200 is realized, which greatly improves work efficiency, eliminates the positioning and angle errors of robot mounting, and is beneficial for improving the mounting accuracy of the floor 200.

Other configurations and operations of the floor mounting tooling 100 according to the embodiments of the present disclosure are known to those of ordinary skill in the art, and are not described in detail here.

In the description of this specification, the description with reference to the terms of "embodiments", "examples" and the like means that specific features, structures, materials or characteristics described in conjunction with the embodiments or examples are included in at least one embodiment or example of the present disclosure. In this specification, the schematic representations of the above-mentioned terms do not necessarily refer to the same embodiment or example. Moreover, the described specific features, structures, materials or characteristics can be combined in any one or more embodiments or examples in a suitable manner.

Although the embodiments of the present disclosure have been shown and described, those of ordinary skill in the art can understand that various changes, modifications, substitutions and variants can be made to these embodiments without departing from the principle and purpose of the present disclosure. The scope of the present disclosure is defined by the claims and their equivalents.

What is claimed is:

1. A floor mounting tooling, configured to mount floors, wherein two opposite sides of each floor are provided with an engaging protrusion and an engaging slot, the engaging protrusion of a floor is used to be fitted with the engaging slot of another floor, and the floor mounting tooling comprises:

a telescopic member;

a hook pivotally provided on the telescopic member, wherein the hook is pivotable away from an initial position or back to the initial position, a hook portion is provided on a side of the hook proximate to the telescopic member, the hook portion is used to be fitted into the engaging slot to hook the floor, and the hook is configured to be rotatable within a defined angle range with respect to the engaging slot; and an elastic member provided between the hook and the telescopic member, wherein the elastic member is configured to drive the hook to rotate toward the initial position.

2. The floor mounting tooling of claim 1, wherein the telescopic member comprises a driving member and a telescopic portion, the driving member is connected to the telescopic portion to drive the telescopic portion to extend or retract along a mounting direction of the floor, and the hook is pivotally provided on the telescopic portion.

3. The floor mounting tooling of claim 2, wherein the hook comprises:

a main body formed as a rectangular plate shape;

two lugs provided on two ends of the main body in a length direction, wherein the hook and the lugs are provided on two ends of the main body in a width direction, and the two lugs are pivotally connected to the telescopic portion.

4. The floor mounting tooling of claim 3, wherein the hook portion is formed on a bottom side of the main body away from the lugs.

5. A floor mounting device, comprising:

an actuator capable of at least being used to vertically and horizontally move; and a plurality of mounting toolings provided side by side on the actuator, and each of the plurality of mounting toolings is the floor mounting tooling according to claim 1.

6. A floor mounting tooling, configured to mount floors, wherein two opposite sides of each floor are provided with an engaging protrusion and an engaging slot, the engaging protrusion of a floor is used to be fitted with the engaging slot of another floor, and the floor mounting tooling comprises:

a telescopic member;

a hook pivotally provided on the telescopic member, wherein the hook is pivotable away from an initial position or back to the initial position, a hook portion is provided on a side of the hook proximate to the telescopic member, the hook portion is used to be fitted into the engaging slot to hook the floor, and the hook is configured to be rotatable within a defined angle range with respect to the engaging slot; and an elastic member provided between the hook and the telescopic member, wherein the elastic member is configured to drive the hook to rotate toward the initial position, wherein the telescopic member comprises a driving member and a telescopic portion, the driving member is connected to the telescopic portion to drive the telescopic portion to extend or retract along a mounting direction of the floor, and the hook is pivotally provided on the telescopic portion, wherein the hook comprises:

a main body formed as a rectangular plate shape;

two lugs provided on two ends of the main body in a length direction, wherein the hook and the lugs are provided on two ends of the main body in a width direction, and the two lugs are pivotally connected to the telescopic portion, and wherein the floor mounting tooling further comprises: a rotating shaft, wherein the rotating shaft is provided on the telescopic portion, the two lugs are provided with mounting holes, two ends of the rotating shaft are respectively fitted into the two mounting holes.

7. A floor mounting tooling, configured to mount floors, wherein two opposite sides of each floor are provided with an engaging protrusion and an engaging slot, the engaging protrusion of a floor is used to be fitted with the engaging slot of another floor, and the floor mounting tooling comprises:

a telescopic member;

a hook pivotally provided on the telescopic member, wherein the hook is pivotable away from an initial position or back to the initial position, a hook portion is provided on a side of the hook proximate to the telescopic member, the hook portion is used to be fitted into the engaging slot to hook the floor, and the hook is configured to be rotatable within a defined angle range with respect to the engaging slot; and an elastic member provided between the hook and the telescopic member, wherein the elastic member is configured to drive the hook to rotate toward the initial position, wherein the telescopic member comprises a driving member and a telescopic portion, the driving member is connected to the telescopic portion to drive the telescopic portion to extend or retract along a mounting direction of the floor, and the hook is pivotally provided on the telescopic portion, wherein the hook comprises:

a main body formed as a rectangular plate shape;

two lugs provided on two ends of the main body in a length direction, wherein the hook and the lugs are provided on two ends of the main body in a width direction, and the two lugs are pivotally connected to the telescopic portion, and wherein the main body is provided with a receiving through hole, the receiving through hole is provided along a thickness direction of the main body, and the elastic member is inserted in the receiving through hole.

8. The floor mounting tooling of claim 7, wherein a side of the telescopic portion away from the main body is provided with a fixed plate, an end of the elastic member is connected to the fixed plate and the other end of the elastic member is provided in the receiving through hole.

9. The floor mounting tooling of claim 8, wherein two sets of the elastic members are provided along a length direction of the main body, two receiving through holes are provided along the length direction of the main body, and the two sets of the elastic members and the two receiving through holes are provided in a one-to-one correspondence.

10. The floor mounting tooling of claim 9, wherein each set of the elastic members has two elastic members provided to be spaced apart in the receiving through hole.

11. The floor mounting tooling of claim 10, wherein the elastic members are first and second springs, the main body is provided with two first through holes communicating with the receiving through holes, and the fixed plate is provided with two second through holes, one end of the first spring is provided on one of the two first through holes through a pin shaft, and another of the first spring is hooked on one of the two second through holes; and one end of the second spring is provided on the other of the two first through holes through a further pin shaft, and another end of the second spring is hooked on the other of the two second through holes.

* * * * *